US011440710B2

(12) United States Patent
Scotton et al.

(10) Patent No.: US 11,440,710 B2
(45) Date of Patent: Sep. 13, 2022

(54) SELF-VENTING CLOSURE

(71) Applicant: Silgan Dispensing Systems Slatersville, LLC, Slatersville, RI (US)

(72) Inventors: James E. Scotton, Foxborough, MA (US); Patrick J. Brannon, Warwick, RI (US)

(73) Assignee: Silgan Dispensing Systems Slatersville, LLC, Slatersville, RI (US)

( * ) Notice: Subject to any disclaimer, the term of this patent is extended or adjusted under 35 U.S.C. 154(b) by 0 days.

(21) Appl. No.: 16/917,863

(22) Filed: Jun. 30, 2020

(65) Prior Publication Data

US 2021/0403212 A1 Dec. 30, 2021

(51) Int. Cl.
*B65D 51/16* (2006.01)

(52) U.S. Cl.
CPC ..... *B65D 51/1644* (2013.01)

(58) Field of Classification Search
CPC ..... B65D 51/1644; B65D 51/1616; B65D 41/04; B65D 77/225; B65D 81/2038; B65D 2205/00; F16K 15/148; F16K 17/02; F16K 27/0209; Y10T 137/789; Y10T 137/784; Y10T 137/7826; Y10T 137/7837; Y10T 137/7847; Y10T 137/786; Y10T 137/7869
USPC ..... 220/200, 202, 203.1, 203.19, 367.1, 220/203.13; 215/200, 247, 248, 260, 307, 215/311; 222/1, 153.06, 481.5, 490–491, 222/494; 137/854, 512.15, 505.42, 511, 137/513.3, 516.13, 517
See application file for complete search history.

(56) References Cited

U.S. PATENT DOCUMENTS 2,224,296 A * 12/1940 Hoffman ..... B65D 51/1644 215/260
2,894,524 A * 7/1959 Gill ..... H01M 50/308 429/84
3,454,182 A * 7/1969 Morton ..... F16K 24/06 220/374
3,511,407 A * 5/1970 Palma ..... A61J 9/04 215/11.1
3,595,429 A * 7/1971 Kohen ..... H01M 50/317 220/203.13

(Continued)

FOREIGN PATENT DOCUMENTS

AU 2013204434 B2 * 12/2016 ..... A61J 9/00
GB 2249084 A * 4/1992 ..... B65B 31/047
WO WO-2016089912 A1 * 6/2016 ..... F16K 15/148

*Primary Examiner* — Chun Hoi Cheung
*Assistant Examiner* — Brijesh V. Patel
(74) *Attorney, Agent, or Firm* — Barlow, Josephs & Holmes, Ltd.; Stephen J. Holmes

(57) ABSTRACT

A self-venting closure assembly includes a closure body having a deck with a peripheral mounting skirt and an annular seal on an underside of the deck adjacent to the peripheral mounting skirt. The closure body further includes a circular valve seat within the center portion of the deck, and a plurality of vent openings circumferentially spaced within the valve seat. An elastomeric umbrella valve is centrally mounted to the deck and has a frustoconical valve flap arranged on an underside of the valve seat. The valve flap cooperates with the vent openings to normally seal the vent openings but permits air to flow into an interior of the closure body when a vacuum is applied to an interior of the container on which the closure is mounted.

16 Claims, 8 Drawing Sheets

(56) References Cited

U.S. PATENT DOCUMENTS 4,019,629 A * 4/1977 Dubner ..... A63B 39/025 206/315.9
4,135,513 A * 1/1979 Arisland ..... A61J 11/002 215/11.4
4,210,255 A * 7/1980 Pan ..... B65D 51/1644 215/310
4,360,326 A * 11/1982 Buchholz ..... F16K 15/148 55/420
4,401,224 A * 8/1983 Alonso ..... A61J 9/04 137/511
4,420,101 A * 12/1983 O'Neill ..... B65D 51/1644 137/859
4,428,478 A * 1/1984 Hoffman ..... F04B 33/00 206/315.9
4,506,809 A * 3/1985 Corsette ..... B65D 47/2081 137/493
4,640,426 A * 2/1987 Wasley ..... B65D 51/24 53/88
4,750,314 A * 6/1988 Mietz ..... B65D 83/42 53/473
4,763,802 A * 8/1988 Johnston ..... B67D 1/10 215/228
5,027,784 A * 7/1991 Osawa ..... F16K 15/148 123/572
5,129,426 A * 7/1992 Boehmer ..... F16K 15/148 137/798
5,397,024 A * 3/1995 Wu ..... B65D 51/1683 215/309
5,449,079 A * 9/1995 Yang ..... B65D 81/2038 215/262
5,507,318 A * 4/1996 Israelson ..... F04B 53/1065 137/854
5,619,972 A * 4/1997 Kuenzli ..... F02M 69/54 123/511
5,649,859 A * 7/1997 Shiga ..... F24F 7/02 174/16.1
5,848,690 A * 12/1998 Granger ..... B65D 51/1677 206/315.9
5,908,129 A * 6/1999 Schutz ..... B65D 51/1644 220/203.11
5,944,211 A * 8/1999 Woodnorth ..... B65D 81/2038 220/203.13
5,974,819 A * 11/1999 Poling ..... H01H 9/047 236/91 A
5,988,414 A * 11/1999 Schwarz ..... B65D 51/1616 215/261
6,021,912 A * 2/2000 Hertrampf ..... B65D 51/1661 215/270
6,035,769 A * 3/2000 Nomura ..... A47J 36/027 219/730
6,341,721 B1 * 1/2002 Herald ..... B65D 47/243 222/548
6,364,163 B1 * 4/2002 Mueller ..... B65D 83/0072 222/481.5
6,516,829 B1 * 2/2003 Townsend ..... B60T 17/004 137/512.15
6,557,462 B1 * 5/2003 Wang ..... A47J 47/10 219/732
6,644,510 B2 * 11/2003 Kawolics ..... F16K 17/02 222/105
6,874,656 B2 * 4/2005 Rohr ..... B65D 51/165 222/1
6,883,675 B2 * 4/2005 Maenke ..... B65D 51/1644 220/203.11
6,951,295 B1 * 10/2005 Gaus ..... B05B 11/007 222/484
7,082,967 B2 * 8/2006 Sarajian ..... F16K 15/148 137/512.15
7,201,287 B2 * 4/2007 Maenke ..... B65D 7/045 220/203.11
7,249,694 B2 * 7/2007 Masuda ..... B65D 47/2075 222/212
7,500,585 B2 * 3/2009 Masuda ..... B65D 47/2075 137/614.2
7,621,416 B2 * 11/2009 Bursztein ..... B65D 43/0218 220/231
7,900,788 B2 * 3/2011 Gaillot ..... B65D 41/0421 215/DIG. 1
D643,288 S * 8/2011 Taylor ..... B65D 51/1644 D9/453
8,146,765 B2 * 4/2012 Chen ..... B65D 53/02 220/231
8,376,164 B2 * 2/2013 Perrin ..... B65D 41/46 215/DIG. 1
8,434,633 B2 * 5/2013 Beer ..... B65D 77/225 220/89.1
D687,709 S * 8/2013 Taylor ..... A61J 11/002 D9/453
9,618,131 B2 * 4/2017 Lee ..... B65D 77/225
9,701,452 B2 * 7/2017 Lackey ..... B65D 81/2038
9,713,402 B2 * 7/2017 Park ..... B65D 1/32
9,714,126 B2 * 7/2017 Rye ..... B65D 51/28
10,273,061 B1 * 4/2019 Lin ..... B65D 1/32
2003/0038131 A1 * 2/2003 Nomura ..... A47J 36/027 219/735
2005/0045666 A1 * 3/2005 Kasting ..... B65D 47/24 222/549
2007/0205194 A1 * 9/2007 Tung ..... B65D 81/263 220/203.15
2008/0105674 A1 * 5/2008 Hsu ..... A47J 36/027 219/735
2008/0110911 A1 * 5/2008 Chen ..... B65D 45/32 220/788
2008/0178884 A1 * 7/2008 Gerson ..... A62B 9/02 128/206.15
2010/0084396 A1 * 4/2010 Wu ..... B65D 45/20 220/203.29
2010/0263328 A1 * 10/2010 Dorsey ..... B65D 81/2015 53/432
2012/0138171 A1 * 6/2012 Coolens ..... F16K 27/0209 137/511
2012/0248110 A1 * 10/2012 Wu ..... B65D 43/0208 220/203.21
2012/0267369 A1 * 10/2012 Duvigneau ..... B65D 81/262 220/203.01

* cited by examiner

SELF-VENTING CLOSURE

BACKGROUND OF THE INVENTION

(1) Field of the Invention

The instant invention generally relates to a liquid dispensing system with an unvented dispensing tap that requires a separate vent opening to prevent paneling of the container when product is dispensed from the tap.

(2) Description of Related Art

Existing dispensing systems with unvented dispensers require a separate vent opening to allow proper operating of the dispensing tap and to prevent paneling of the container caused by a vacuum within the container as product is dispensed. An example of this type of system is a large format laundry detergent container. The existing systems typically include a vent opening with a threaded neck and a closure which is screwed tightly closed for storage and handling, but which must be partially unscrewed to allow air into the vent opening during use. This required action is a particular point of complaint for the consumer. Many users fail to unscrew the closure, or fail to unscrew it a sufficient amount, to allow appropriate venting for proper performance of the dispensing tap.

SUMMARY OF THE INVENTION

The present disclosure describes a self-venting closure assembly which does not require any action by the consumer for proper functionality.

An exemplary embodiment comprises a self-venting closure assembly comprising a closure body having a deck with a peripheral mounting skirt and an annular seal on an underside of the deck adjacent to the peripheral mounting skirt. The closure is configured for and intended to be used with a container for a liquid product which has an unvented dispensing tap.

In some embodiments the mounting skirt may be threaded or provided with bayonet type connection so that it can be removably mounted onto a neck of a vent opening in the container. In other embodiments, the mounting skirt may be permanently secured about the vent opening of the container. The annular seal may in some embodiments comprise an annular gasket received between the deck and the lip of the vent opening in the container. In other embodiments the annular seal may comprise a sealing rib which extends downwardly from the underside of the deck and engages the container neck.

With respect to the venting function, the closure body includes a circular valve seat within the center portion of the deck, and a plurality of vent openings concentrically spaced around the center of the valve seat.

An elastomeric umbrella valve includes a mounting stem centrally mounted through a mounting hole in the deck and has a frustoconical valve flap arranged on an underside of the valve seat. The valve flap extends radially outward from the mounting stem and cooperates with the vent openings to normally seal the vent openings, but permits air to flow into an interior of the closure body when a vacuum is applied to an interior of the container on which the closure is mounted.

It can thus be appreciated that the exemplary embodiment provides a unique self-venting closure which eliminates the need for the consumer to manually open a vent cap while also reducing any potential leak points between the liquid product in the container and the environment.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
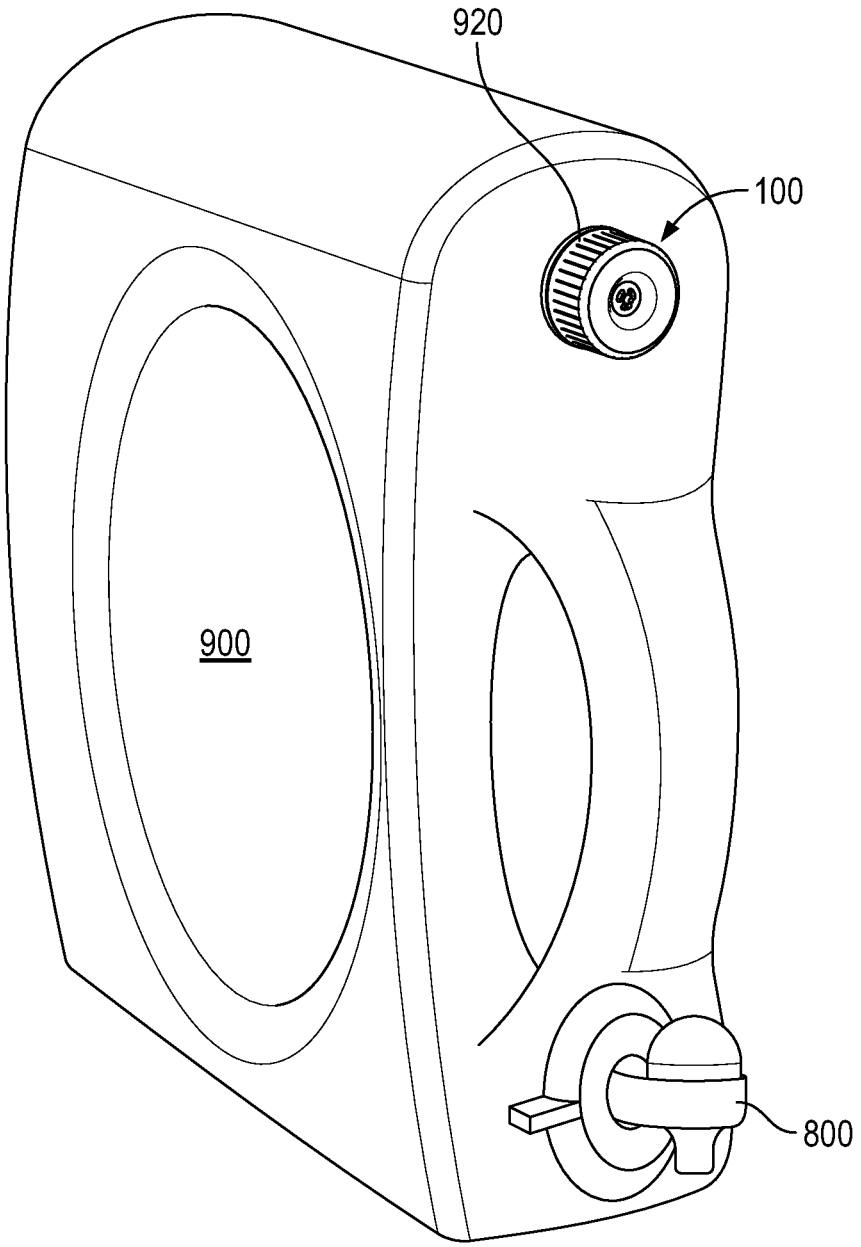
FIG. 1 is a perspective view of an exemplary embodiment of a self-venting closure mounted on a container with a dispensing tap in accordance with the present invention.
Figure 2:
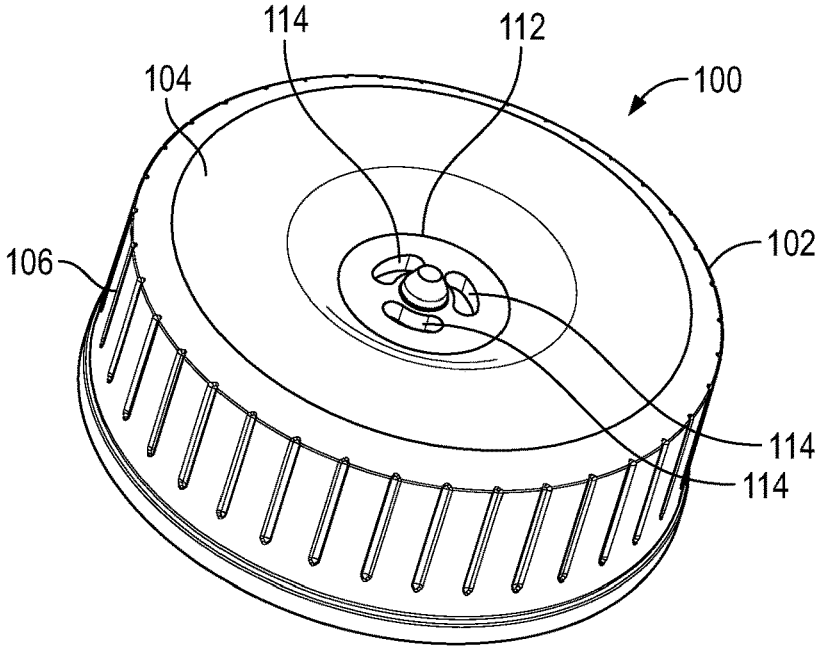
FIG. 2 is a perspective view of the self-venting closure.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Referring now to the drawings, an exemplary embodiment of a self-venting closure 100 is illustrated in FIGS. 1-8. While reference is made to dispensing systems for liquid products, it should be understood that the presently described types of self-venting closures can also be used with other dispensing systems.

Referring to FIG. 1, an exemplary dispensing container 900 and self-venting closure 100 is illustrated. The container 900 is generally configured for holding a volume of liquid product (not shown) which can be dispensed through a tap-like dispenser 800. The container 900 may be formed from a blow-molded plastic material or may be formed by and from other means and materials. The dispensing tap 800 may be unvented and thus the container 900 may require a separate vent opening 910 to allow proper operating of the dispensing tap 800 and to prevent paneling of the sidewalls of the container 900 caused by a vacuum within the container 900 as product (not shown) is dispensed from the tap 200. An example of this type of system is a large format laundry detergent container, but other liquid dispensing systems and dispensing taps are also contemplated.

Figure 4:
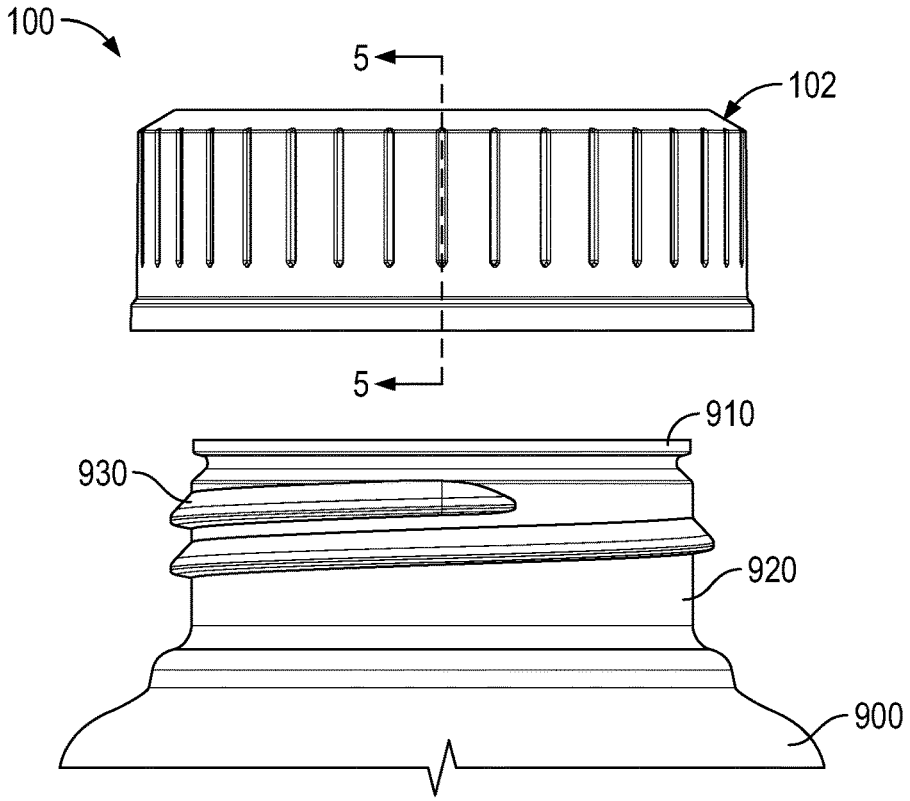
FIG. 4 is a plan view thereof shown with an exemplary venting neck.

Referring briefly to FIGS. 1 and 4, the vent opening 910 comprises a neck 920 which projects from the container 900 at a location which will be positioned above the liquid level when the container is in use.

An exemplary self-venting closure assembly 100 comprises a closure body 102 having a deck 104 with a peripheral mounting skirt 106 extending therefrom and an annular seal 108 on an underside of the deck 104 adjacent to the peripheral mounting skirt 106. The seal 108 is intended to cooperate with the container neck 920 to form a seal between the underside of the deck 104 and the container neck 920. The closure body 102 may be molded or otherwise formed from a high density polyethylene (HDPE) plastic, or other suitable plastic material.

Figure 3:
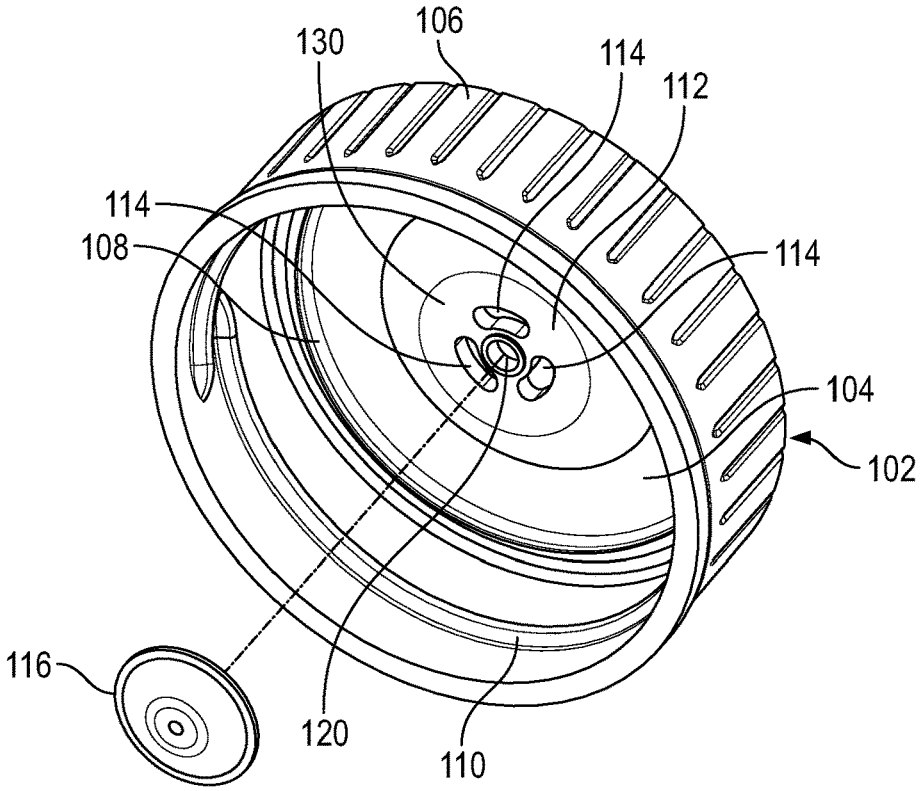
FIG. 3 is an exploded perspective view thereof.
Figure 5:
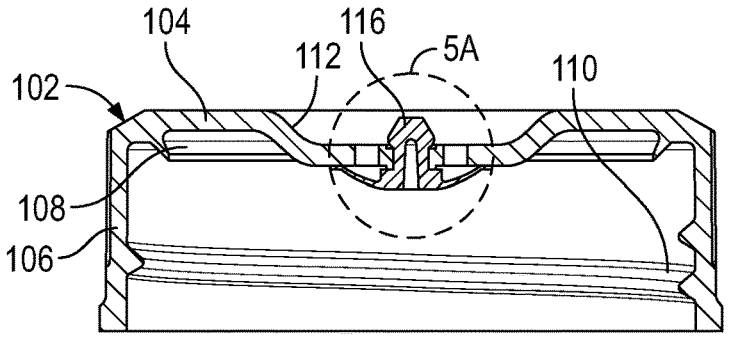
FIG. 5 is a cross-sectional view thereof taken along line 5-5 of FIG. 4.

In some embodiments the mounting skirt 106 and container neck 920 may include complementary mounting formations for releasable or permanent attachment of the closure body 100 to the container 900. For example, the mounting formations may comprise mating threads 110/930 or bayonet surfaces. In some embodiments the mounting skirt 106 may be inwardly threaded as illustrated in FIGS. 3 and 5 so that it can be removably mounted onto a similarly threaded or configured neck 920 of the vent opening 910 in the container 900. In other embodiments, the mounting skirt 106 may be permanently secured about the vent opening 910 of the container 900 by ultrasonic welding or other securing means.

The annular seal 108 may in some embodiments comprise an annular sealing rib which extends downwardly from the underside of the deck 104 to engage and cooperate with the container neck 920. Referring to FIG. 5, in the present embodiment the sealing rib 108 is v-shaped and angled slightly inward so that it extends over the upper lip of the vent neck 920 and rolls inwardly forming a tight seal.

The self-venting function is provided by a circular valve seat 112 within the center portion of the deck 104, a plurality of vent openings 114 concentrically spaced around the center of the valve seat 112 and an umbrella valve 116.

The valve seat 112 may be flush with the rest of the deck 104 or may be slightly recessed inwardly. At least one vent opening 114 must be provided. However, a plurality of circumferentially spaced vent openings 114 has been found to be particularly effective.

Figure 7:
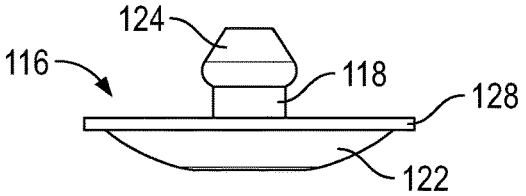
FIG. 7 is plan view of the umbrella valve.
Figure 8:
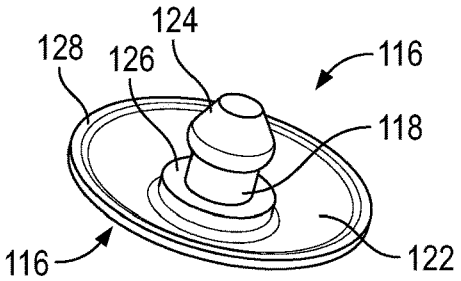
FIG. 8 is a perspective view of the umbrella valve.
Figure 9:
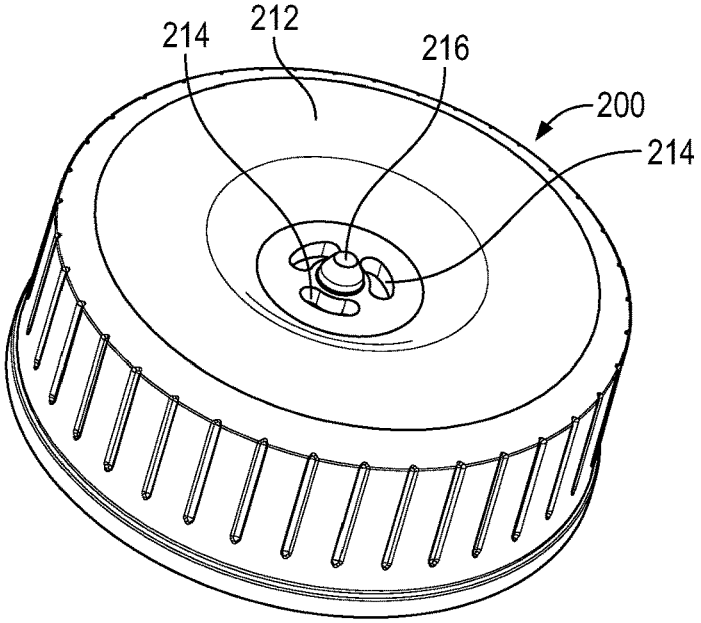
FIG. 9 is a perspective view of another exemplary embodiment of a self-venting closure

Referring to FIGS. 7 and 8, the elastomeric umbrella valve 116 includes a mounting stem 118 mounted through a mounting hole 120 in the center deck 104 and further has a frustoconical valve flap 122 arranged to extend from the mounting stem 118 to an underside of the valve seat 112. The umbrella valve 116 may be formed from silicone or other similar elastomeric materials. To retain the umbrella valve 116 in the mounting hole 120, the mounting stem includes spaced retaining shoulders 124, 126, one being received above the valve seat 112 and the other below the valve seat 112.

The valve flap 122 extends radially outward from the mounting stem 118 terminating in a peripheral annular sealing rim 128 with a flat sealing surface that engages with a circular land area 130 encircling the vent openings 114. The valve flap 122 cooperates with the vent openings 114 and land area 130 to normally seal the vent openings 114 from the interior of the closure body 102, but elastically deforms to permit air to flow into an interior of the closure body 102 when a vacuum is applied to an interior of the container 900 on which the closure 100 is mounted.

Figure 5A:
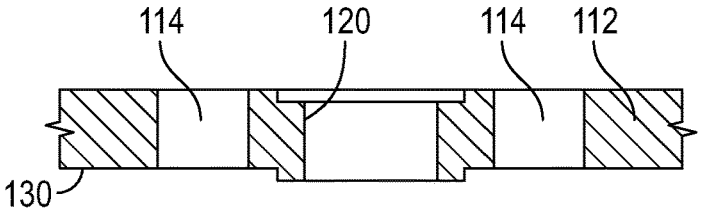
FIG. 5A is an enlarged view of the mounting hole from FIG. 5 with the umbrella valve removed for clarity.
Figure 6:
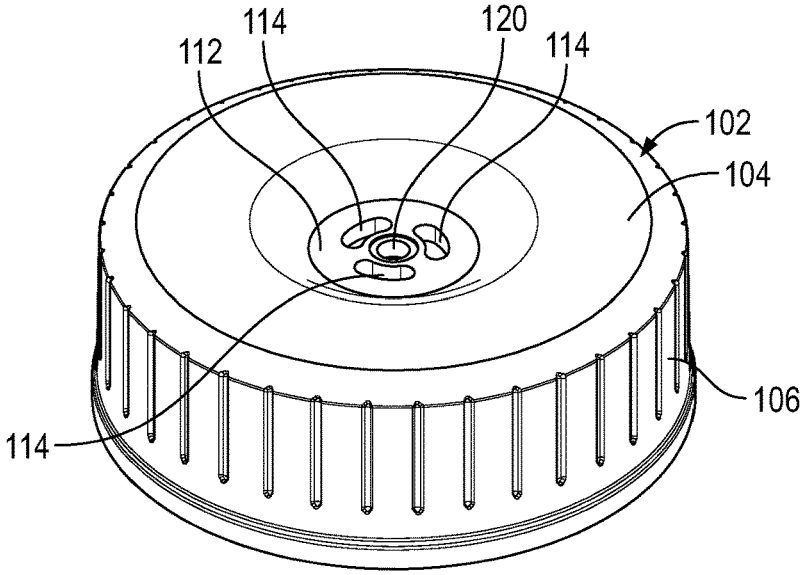
FIG. 6 is a perspective view of the closure body.

It can be seen in enlarged FIG. 5A that the upper and lower surfaces immediately surrounding the mounting hole 120 may be offset inwardly from the remainder of the valve seat 112. This offset may allow the maker to reduce the preloaded tension normally molded into the umbrella valve structure 116. Lowering the position of the valve flap 122 and sealing rim 128 relative to the land surface 130 decreases the normal sealing force and allows adjustment of the amount of vacuum required to open the valve 116.

Referring now to FIGS. 9-14 another exemplary embodiment of a self-venting closure assembly is illustrated and generally indicated at 200. The closure assembly 200 is generally the same as the previously described embodiment 100 and includes the same closure body 202, valve seat 212, vent openings 214, and umbrella valve 216, with only the following differences.

Figure 10:
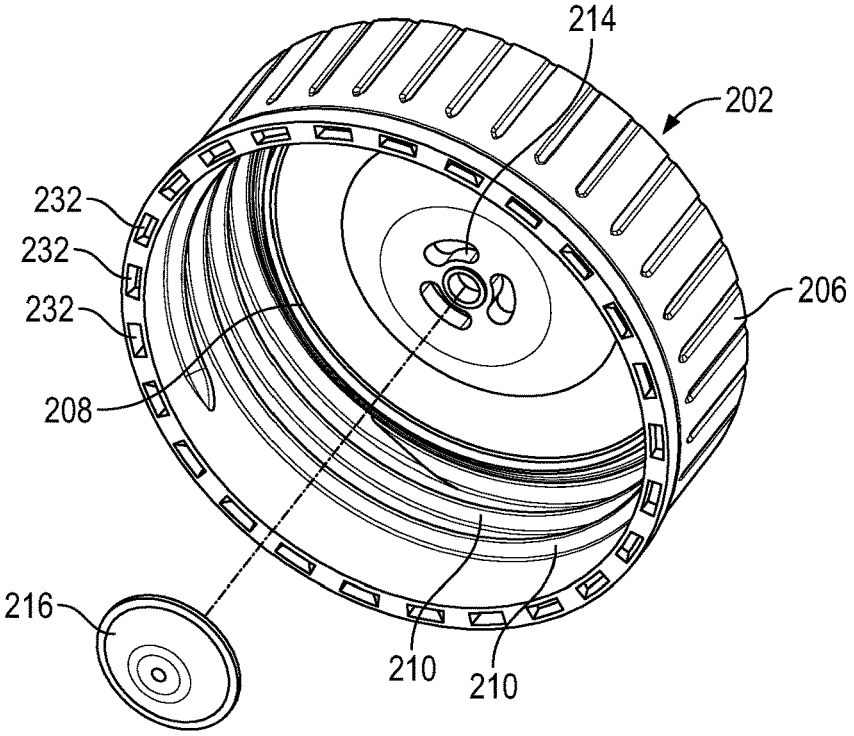
FIG. 10 is an exploded perspective view thereof.
Figure 11:
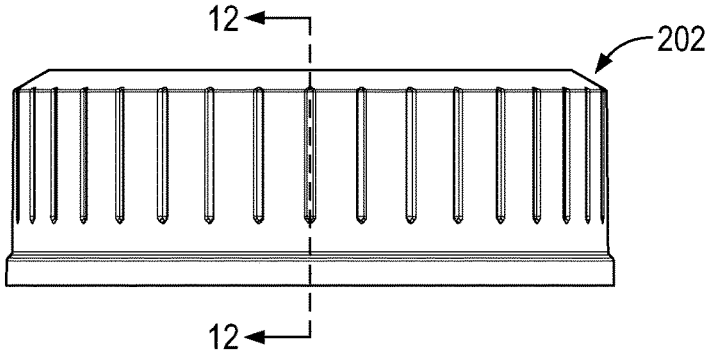
FIG. 11 is a plan view thereof.
Figure 14:
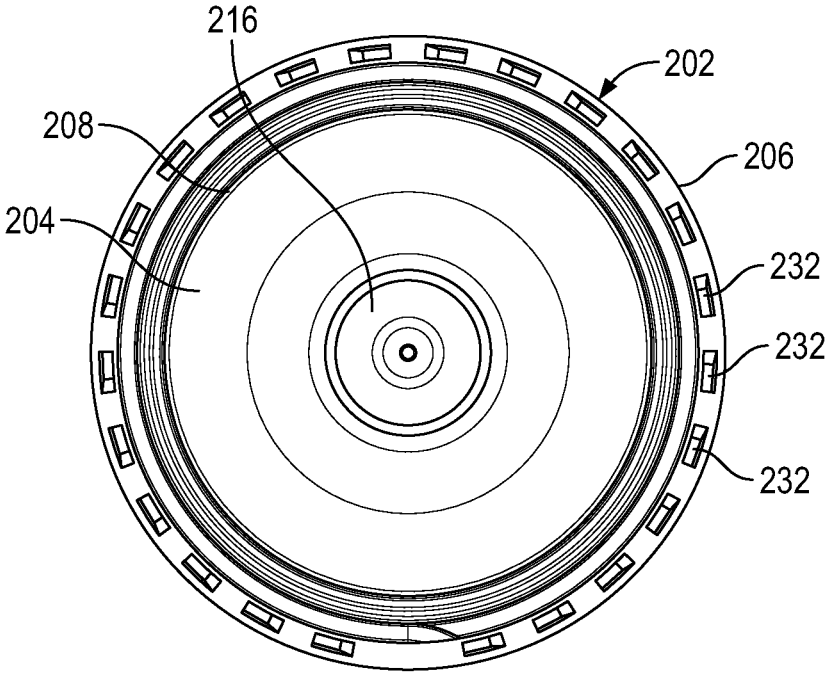
FIG. 14 is bottom view of the closure body.
Figure 15:
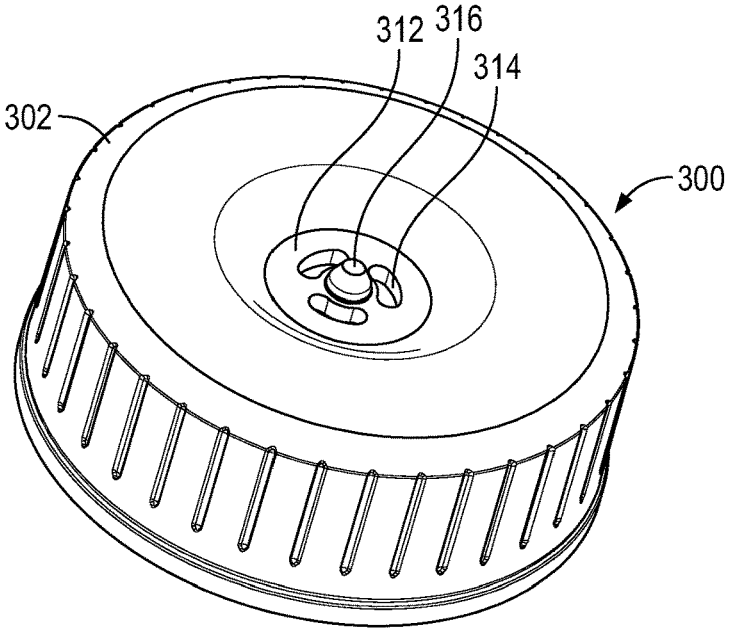
FIG. 15 is a perspective view of yet another exemplary embodiment of a self-venting closure.

Referring to FIGS. 10 and 14, the lower edge of the mounting skirt 206 is provided with a plurality of unscrewing "dogs" 232 or indentations which engage with a like plurality of projections (not shown) on the container 900 to prevent unscrewing of the closure 200 once mounted. The mounting skirt 206 has several additional rotations of threads 210 to strengthen the closure force.

Figure 12:
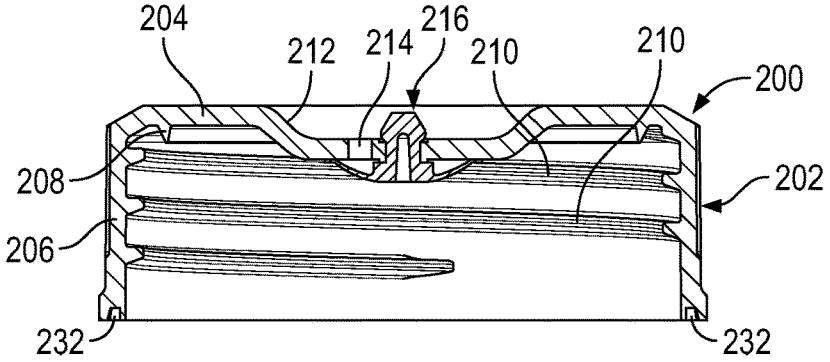
FIG. 12 is a cross-sectional view thereof taken along line 12-12 of FIG. 11.
Figure 13:
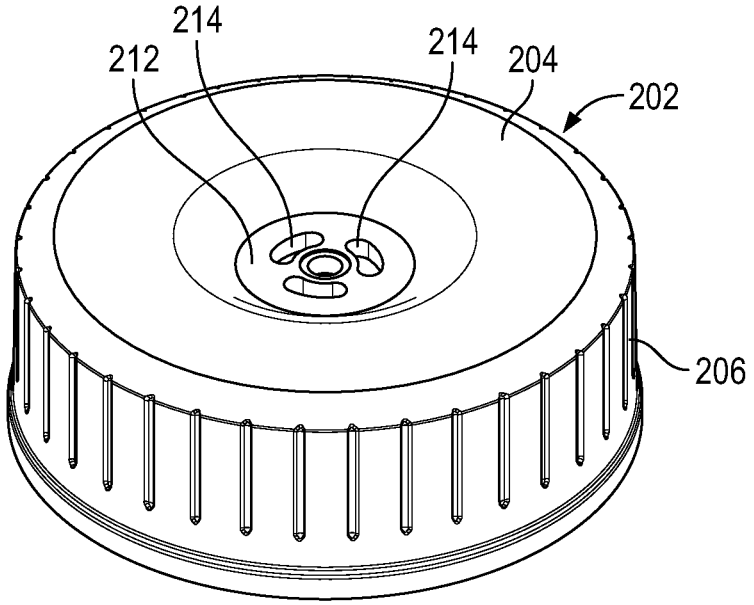
FIG. 13 is a perspective view of the closure body.

Referring to FIG. 12, it can be seen that in some embodiments the annular seal 208 may comprise a v-shaped rib without the inward angle. The straight v-shape can be used with the additional threads 210 which provide added sealing force against the underside of the closure deck 204.

The closure 200 is otherwise similar in structure and function to the embodiment 100 described above.

Referring now to FIGS. 15-19 yet another exemplary embodiment of a self-venting closure assembly is illustrated and generally indicated at 300. This closure assembly 300 is also generally the same as the previously described embodiment 100 and includes the same closure body 302, valve seat 312, vent openings 314 and umbrella valve 316, with only the following differences.

Figure 16:
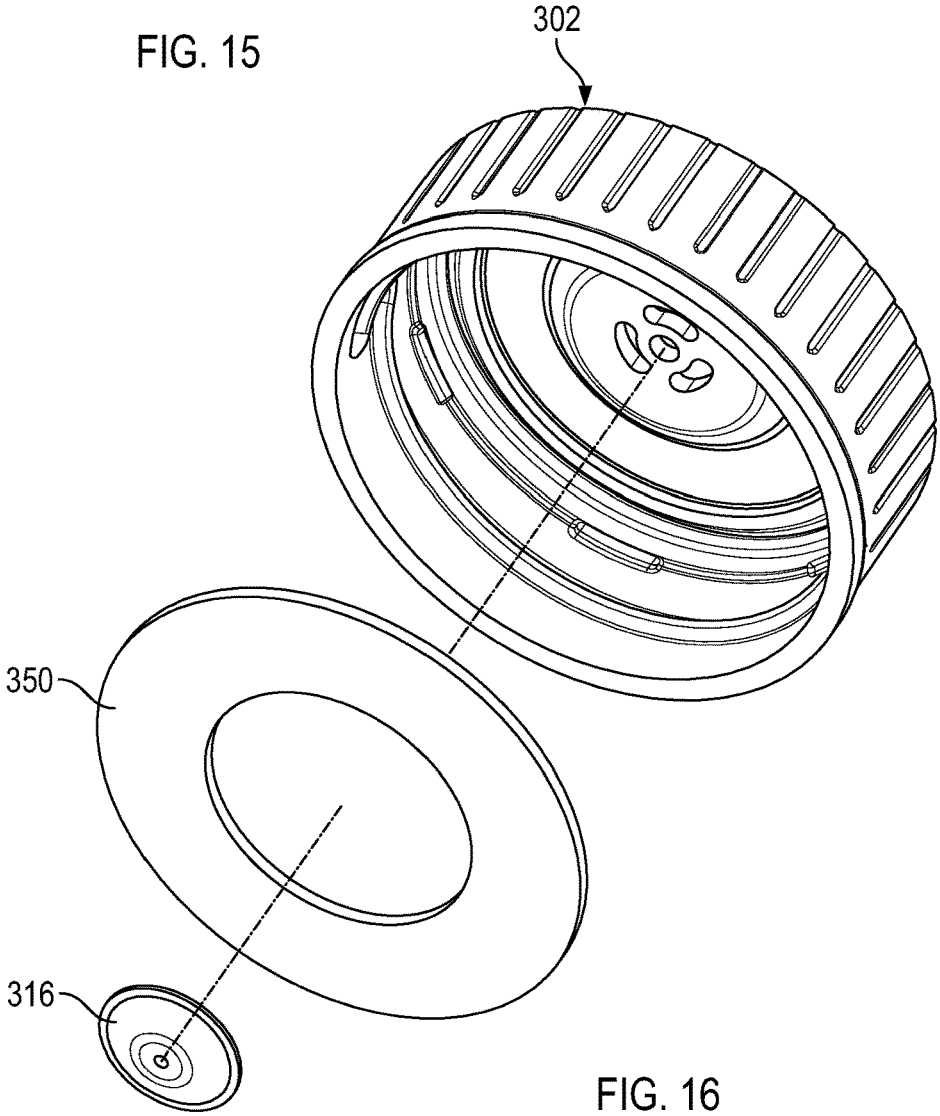
FIG. 16 is an exploded perspective view thereof.
Figure 17:
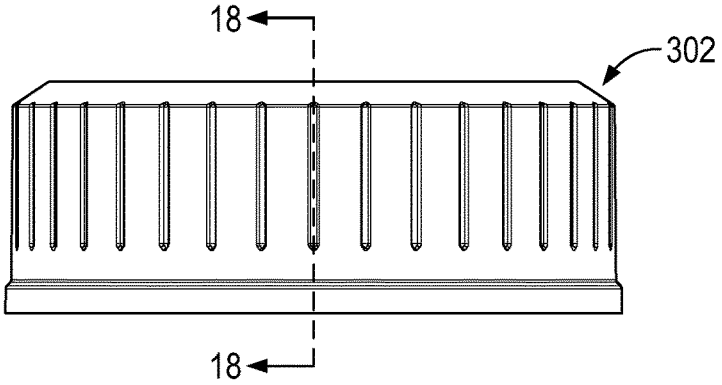
FIG. 17 is a plan view thereof.
Figure 18:
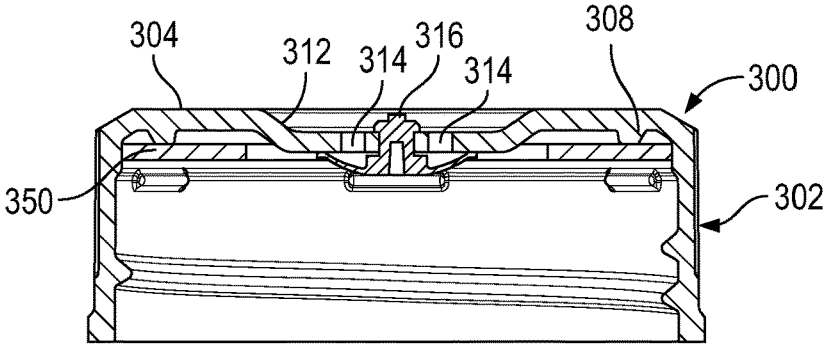
FIG. 18 is a cross-sectional view thereof taken along line 18-18 of FIG. 17.
Figure 19:
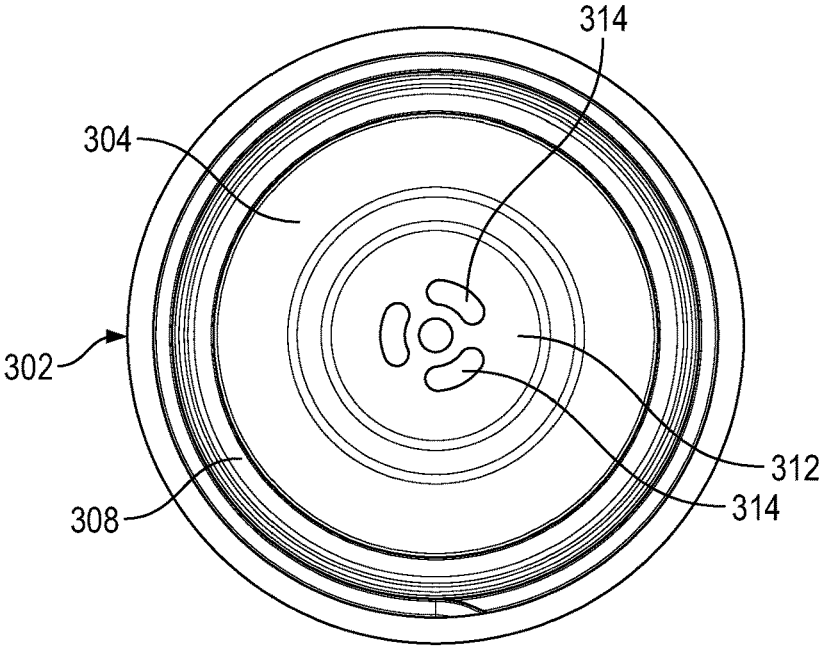
FIG. 19 is a bottom view of the closure body.

Referring to FIGS. 16 and 18, the assembly 300 further includes an annular foam or elastomeric gasket 350 received between the underside of the deck 304 and the upper lip of the vent opening 910 in the container 900.

Referring to FIG. 18 in particular, it can be seen that the annular seal 308 may comprise a flattened rib with a slight inward angle on its outer peripheral surface which is effective for squeezing the gasket 350 against the vent neck 920. Additionally, the valve seat 312 does not contain any offset providing the umbrella valve 316 with a full preloaded tension as molded.

The closure 300 is otherwise similar in structure and function to the embodiment 100 described above.

It can thus be appreciated that the exemplary embodiments provide unique configurations of a self-venting closure assemblies which simplify and reduce the number of parts and provide automatic venting without customer intervention, while also reducing the number of potential leak points between the liquid container and the exterior environment.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A closure assembly comprising:

a closure body having a deck with a peripheral mounting skirt, a flattened annular sealing rib on an underside of the deck adjacent to the peripheral mounting skirt, said flattened annular sealing rib having a downward facing engagement surface generally parallel to the deck, a valve seat within the deck, and a vent opening disposed within the valve seat;

an annular gasket received adjacent to the underside of the deck and having an upward facing top surface in engagement with said downward facing engagement surface of said flattened annular sealing rib, said flattened annular sealing rib having an inward angle on an outer peripheral surface thereof; and an elastomeric umbrella valve mounted to the deck and having a valve flap arranged on an underside of the valve seat, said valve flap cooperating with said vent opening to normally seal said vent opening but permitting air to flow into an interior of the closure body.

2. The closure assembly of claim 1 wherein the umbrella valve includes an axial mounting stem which is removably received within a mounting hole within the valve seat.

3. The closure assembly of claim 2 wherein the closure body includes a plurality of vent openings spaced circumferentially around the mounting hole and the valve flap extends radially outwardly from the mounting stem to seal said plurality of vent openings.

4. The closure assembly of claim 3 wherein the underside of said valve seat includes a circular land area disposed radially outward of said vent openings and said valve flap includes an annular sealing rim which engages with said circular land area.

5. The closure assembly of claim 3 wherein the peripheral mounting skirt includes mounting formations configured for engagement with a container neck.

6. The closure assembly of claim 5 wherein said flattened annular sealing rib and said annular gasket cooperate to form a seal against an upper peripheral edge of said container neck when received in assembled relationship therewith.

7. The closure assembly of claim 3 wherein the mounting skirt includes inwardly extending releasable mounting formations.

8. The closure assembly of claim 7 wherein said flattened annular sealing rib and said annular gasket cooperate to form a seal against an upper peripheral edge of said container neck when received in assembled relationship therewith.

9. The closure assembly of claim 3 wherein the mounting skirt is inwardly threaded.

10. The closure assembly of claim 9 wherein said flattened annular sealing rib and said annular gasket cooperate to form a seal against an upper peripheral edge of said container neck when received in assembled relationship therewith.

11. The closure assembly of claim 1 wherein the peripheral mounting skirt includes mounting formations configured for engagement with a container neck.

12. The closure assembly of claim 11 wherein said flattened annular sealing rib and said annular gasket cooperate to form a seal against an upper peripheral edge of said container neck when received in assembled relationship therewith.

13. The closure assembly of claim 1 wherein the peripheral mounting skirt includes inwardly extending releasable mounting formations.

14. The closure assembly of claim 13 wherein said flattened annular sealing rib and said annular gasket cooperate to form a seal against an upper peripheral edge of said container neck when received in assembled relationship therewith.

15. The closure assembly of claim 1 wherein the mounting skirt is inwardly threaded.

16. The closure assembly of claim 15 wherein said flattened annular sealing rib and said annular gasket cooperate to form a seal against an upper peripheral edge of said container neck when received in assembled relationship therewith.

* * * * *